United States Patent [19]

France

[11] 4,065,258

[45] Dec. 27, 1977

[54] PROCESS FOR DRY CLEANING LEATHER

[75] Inventor: Haywood Gordon France, South Charleston, W. Va.

[73] Assignee: Union Carbide Corporation, New York, N.Y.

[21] Appl. No.: 664,247

[22] Filed: Mar. 5, 1976

[51] Int. Cl.[2] ..... C14C 9/00

[52] U.S. Cl. ..... 8/142; 8/DIG. 1

[58] Field of Search ..... 8/142, DIG. 1

[56] References Cited

U.S. PATENT DOCUMENTS 3,123,494 3/1964 Charreau ..... 117/62

3,511,699 5/1970 Johnson et al. ..... 428/264

OTHER PUBLICATIONS

Mitton et al., J. Soc. Leath. Tr. Chem., Oct. 1965, pp. 370–385.

*Primary Examiner*—John Kight, III

*Attorney, Agent, or Firm*—Peter R. Shearer

[57] ABSTRACT

The dissolution of a small amount of certain reactive epoxy-containing silicone compounds in solvents used to dry clean leather results in improved and more durable softness and water resistance properties being imparted to the leather.

4 Claims, No Drawings

PROCESS FOR DRY CLEANING LEATHER

During the tanning of leather, natural fats and oils are removed in order that the water-borne tanning and treating chemicals subsequently used can penetrate the leather. The removed fats and oils are later replaced by any of various natural or synthetic oils and lubricants, known as fatliquors, as part of the tanning process to restore softness and flexibility to the processed leather. It is known in the prior art, as shown by Canadian Pat. No. 726,070, that the application of certain water soluble amine-modified silicone copolymers as fatliquors increases the water resistance of leather as well as imparting softness. However, all the fatliquors known in the prior art tend to migrate through the leather and be extracted from the leather by exposure to any one of a variety of dry cleaning solvents. Consequently, the dry cleaning of leather articles with organic solvents causes the removal of fatliquors and concomitant loss of softness, flexibility and water resistance of the leather. Moreover, exposure of leather to water often results in the removal of fatliquors and loss of softness and flexibility. Thus, leather articles which have been dry cleaned with organic solvents or exposed to water tend to become stiff, hard, permeable to moisture and subject to water-borne staining.

The present invention provides an improvement in the process of dry cleaning leathers which will restore and enhance the softness, flexibility and water resistance of the leather.

Various other objects and advantages of the present invention will become obvious to those skilled in the art from the within specification and claims.

SUMMARY OF THE INVENTION

It has been discovered that the dissolution of small amounts by weight of certain reactive epoxy-containing silicone compounds in the solvents used to dry clean leather results in an improvement in the properties of the leather such as softness, flexibility and water resistance. Particularly useful are epoxy-containing silicones of the type described in U.S. Pat. No. 3,511,699. It was a completely unexpected and nonobvious finding that the improved properties imparted by the process of our invention are substantially unimpaired by subsequent exposures to organic solvents or water.

DETAILED DESCRIPTION OF THE INVENTION

The present invention relates to an improvement in the process of dry cleaning leathers wherein a small amount of an epoxy-containing silicone compound is dissolved in the cleaning fluid. The epoxy-containing silicone used in this process has the formula:

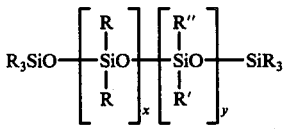

(I)

wherein R is an alkyl radical containing from 1 to 4 carbon atoms, R″ is an alkyl radical containing from 1 to 40 carbon atoms, preferably from 1 to 4 carbon atoms, R′ is an organic radical containing a vicinal epoxy group, $x$ has a value from 10 to 1,000 and $y$ has a value from 1 to 100. The

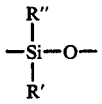

group need not contain the same R″ substituent in all instances. Thus one can have a segment of said group wherein R″ is methyl and another segment is a block wherein R″ is octadecyl. In such instances one has a quadripolymer. Also suitable are those epoxy-containing silicone compounds in which some of the R or R″ groups are alkoxy groups having from 1 to 4 carbon atoms.

Other than the oxygen of the oxirane linkage, oxygen may be present in the organic epoxy radical as ether oxygen, that is —O—. Illustrative of epoxy organic radicals which may be represented by R′ one can mention 3,4-epoxycyclohexyl, 6-methyl-3,4-epoxycyclohexyl, 3,4-epoxycyclohexyl-1-ethyl, 3,4-epoxycyclohexyl-1-isopropyl, 2,3-epoxycyclohexyl-1-ethyl, 2,3-epoxycyclohexyl-1-propyl, 3,4-epoxycyclopentyl-1-ethyl, 3,4-epoxypentyl, 2-glycidoxyethyl, 3-glycidoxypropyl, 3,4-epoxycyclohexyl-1-methoxyethyl, p-(2,3-epoxybutyl)phenyl, 3-(2,3-epoxybutyl) cyclohexyl and the like. Preferred compounds are those having the general formula:

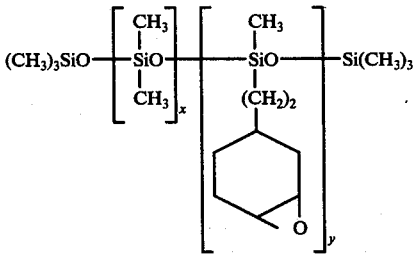

(II)

wherein $x$ is from about 150 to 550 and $y$ is from about 4 to 15. The compounds described above are known, and are described in U.S. Pat. No. 3,511,699.

The epoxy-containing silicone compounds described above can be applied to leather from a solution in any of the solvents conventionally employed in dry cleaning. These solvents are well known to those skilled in the art. Nevertheless, one can mention as illustrative thereof, chlorinated hydrocarbons such as perchloroethylene, carbon tetrachloride, carbon trichloride and mixtures of chlorinated hydrocarbons such as, for example, mixtures of carbon tetrachloride and ethylene dichloride, or petroleum distillates which have flash points from about 100° to 140° F. and are fully recovered in a distillation column at between 350° F. and 410° F. and which are known to those skilled in the art as stoddard solvent and 140° F. solvent. The foregoing list is not meant to exclude other solvents which are known to have utility in dry cleaning, but rather is intended to be illustrative only.

The amount of epoxy-containing silicone dissolved in the dry cleaning solvent bath in the process of our invention is such that the leather absorbs from about 0.5 weight percent to about 10 weight percent, by weight of the leather, of the epoxy-containing silicone, preferably from 0.5 weight percent to 5 weight percent. The epoxy-containing silicone is dissolved in an amount of dry cleaning solvent equal to from 1 to 5 times the weight of the leather being cleaned, preferably, the bath should be from one to about 3 times the weight of the leather. There may also be present in the cleaning fluid, in addition to the organic solvent and epoxy-containing silicone, any other components conventionally employed in dry cleaning fluids, such as, for example, surfactants, in the usual effective amounts.

As the leather is dry cleaned with the epoxy-containing silicone solution, the leather absorbs the epoxy-containing silicone. Thereafter, additional solvent can be added to the dry cleaning bath, if desired, to facilitate further cleaning of the leather, without adversely affecting the properties imparted by the process of our invention. The dissolution of the epoxy-containing silicone compound in the dry cleaning solvent has no adverse effect on the dry cleaning solvent's ability to clean the leather. After the leather has been treated with the epoxy-containing silicone solution as described above, the leather can be processed through the drying and finishing steps conventionally employed in dry cleaning procedures.

The process for dry cleaning leather disclosed herein may be carried out using any of the well known types of equipment available for dry cleaning.

Leathers which have been dry cleaned by the process of this invention display increased softness and resistance to penetration by water. While any leather can be advantageously dry cleaned by this method, the amount of improvement in softness and water resistance varies, depending on the type of leather treated and the manner in which the leather has been tanned. The improvement in water resistance is greater when the dry cleaning solution does not contain surfactants which act as rewetting agents.

The softness and water resistance imparted by the dry cleaning process of our invention is highly durable; that is, softness and water resistance will not be substantially impaired by subsequent repeated exposures to water or organic solvents. While not wishing to be bound by a particular theory of the mechanism involved, it is believed that the epoxy-containing silicone compound reacts with the amine groups of the protein molecules in the leather and becomes permanently bonded thereto.

Repeated treatment of leathers by the dry cleaning process of this invention has no adverse effect on leather. In some instances, it may result in further improvement in softness and water resistance.

In the examples that follow, spray rating, a measure of water resistance, was determined by the method set forth in ASTM-D1913-63. Softness was measured by placing the sample across a ½-in. diameter hole in a platform. The rounded tip of a ¼ in. diameter plunger weighing 152 grams is centered over the hole and allowed to rest on the sample. A depth gauge below the platform measures the leather's deflection. Softness is given in mils of deflection.

EXAMPLE 1

Two six-in. diameter discs were cut from a white finished split cowhide garment leather having an average thickness of about 40 mils, which had been conventionally chrome tanned and fatliquored. The samples, identified as Sample A and Sample B, had initial softness values of 53 mils and 54 mils, respectively, and both had an initial spray rating of 50. Both samples were placed in a one-quart jar containing 250 ml. of perchloroethylene, rotated end over end at room temperature for three hours, removed and dried at 73° F. and 50% relative humidity for 72 hours. The samples were rewet and dried for 72 hours at 73° F. and 50% relative humidity. Sample A was tested for softness, Sample B for softness and spray rating. Sample A had a softness of 38 mils and Sample B had a softness of 39 mils and a spray rating of zero. Sample A was placed in a one-quart jar to which was charged a dry cleaning solution consisting of 2%, based on the weight of the sample, of an epoxy-containing silicone defined by Formula II, where $x$ had an average value of about 490 and $y$ had an average value of about 10, dissolved in 50 ml. of perchloroethylene. The jar was tumbled end over end for 30 minutes and the sample was dried for 72 hours at 73° F. and 50% relative humidity. It was rewet and dried again at 73° F. and 50% relative humidity. Softness and spray rating were measured at 78 mils and 80. Sample A was subjected to another dry cleaning by immersion in perchloroethylene, drying for 72 hours at 73° F. and 50% relative humidity, rewetting, and drying again at 73° F. and 50% relative humidity. Final softness and spray rating were 71 mils and 100. This example illustrates that leather dry cleaned by the process of this invention displays improved softness and water resistance and that subsequent dry cleaning with perchloroethylene has a minimal effect on the properties of softness and water resistance. By comparison, the sample which underwent a single exposure to perchloroethylene and water, and was not dry cleaned by the process of this invention, exhibited loss in water resistance and softness.

EXAMPLE 2

Two six-in. diameter discs were cut from a split cowhide leather which had been tanned with basic chrome sulfate but which had not been fatliquored. The initial softness values of the samples, identified as Sample C and Sample D, were 35 and 41 mils and both discs had an initial spray rating of zero. The samples were processed and tested in a manner similar to the samples of Example 1, with Sample C receiving the treatment by the process of this invention. After initial exposure to perchloroethylene, rewetting and drying, Sample C had a softness of 29 mils and Sample D had a softness of 43 mils and a spray rating of zero. After treatment with the epoxy-modified silicone by the dry cleaning process of this invention, drying, rewetting and drying again, Sample C had a softness of 73 mils and a spray rating of 80. After final exposure to perchloroethylene, drying, rewetting and drying again, the softness of Sample C was 78 mils and the spray rating was 90.

EXAMPLE 3

Two six-in. diameter discs were cut from a sheepskin which had been tanned with basic chrome sulfate, but which had not been fatliquored. Initial softness values of the discs, identified as Sample E and Sample F, were 64 and 61 mils and both discs had a spray rating of 50. The discs were processed and tested in a manner similar to the samples of Example 1, with Sample E receiving the dry cleaning treatment by the process of this invention. After initial exposure to perchloroethylene, drying, rewetting and drying again, Sample E had a softness of 76 mils and Sample F had a softness of 68 mils and a spray rating of 50. After dry cleaning with epoxy-modified silicone in the dry cleaning fluid by the process of this invention, drying, rewetting and drying again, Sample E had a softness of 92 mils and a spray rating of 80. After final exposure to perchloroethylene, drying, rewetting and drying again, the softness of Sample E was 88 mils and the spray rating was 80.

EXAMPLE 4

Two six-in. diameter discs were cut from a finished grain kip leather which had been conventionally chrome tanned and fatliquored. Initial softness values of the discs, identified as Sample G and Sample H, were 33 and 41 mils and both discs had a spray rating of zero. The discs were processed and tested in a manner similar to the samples of Example 1, with Sample G receiving the dry cleaning treatment by the process of this invention. After initial exposure to perchloroethylene, rewetting and drying, Sample G had a softness of 29 mils and Sample H had a softness of 36 mils and both had a spray rating of zero. After treatment with epoxy-containing silicone by the dry cleaning process of this invention, drying, rewetting and drying again, Sample G had a softness of 42 mils and a spray rating of 70. After final exposure to perchloroethylene drying, rewetting and drying again, the softness of Sample G was 40 mils and the spray rating was 70.

EXAMPLE 5

Drops of water were applied to the surface of a suede jacket weighing 802 grams and having a softness of 53 mils. Water spots were observed on the jacket. The jacket was then placed in a 3-ft diameter drum for dry cleaning. To the drum there was added a solution of 16 grams of the same epoxy-containing silicone as specified in Example 1 in 3,000 ml. of perchloroethylene. The drum was rotated about a horizontal axis for 15 minutes, after which most of the liquid had been absorbed by the jacket. An additional 4,000 ml. of perchloroethylene was added and the drum was rotated for another 30 minutes. The liquid was drained and the jacket was rinsed by dipping in one gallon of perchloroethylene and dried for 30 minutes in an electric clothers dryer on a delicate setting. The dry cleaned jacket now had a softness of 65 mils, and had a pleasing hand. Water drops were applied to the surface of the jacket and did not cause water spotting, but rather beaded on the surface, indicating good water resistance.

EXAMPLE 6

Drops of water were applied to the surface of a leather coat weighing 942 grams, which had previously been commercially dry cleaned and now had a softness of 67 mils but a harsh unpleasant hand. Water spots were observed on the coat. The coat was then placed in a 3-ft. diameter drum. To the drum there was added a solution of 19 grams of the same epoxy-containing silicone as specified in Example 1 in 3,000 ml. of perchloroethylene as dry cleaning fluid. The drum was rotated about a horizontal axis for 15 minutes, after which most of the liquid had been absorbed by the coat. An additional 4,000 ml. of perchloroethylene was added, the drum was rotated for another 30 minutes and the liquid was drained. The coat was rinsed by dipping it in one gallon of perchloroethylene and dried in an electric clothes dryer on a delicate setting. Softness of the coat dry cleaned by the process of our invention was now 77 mils and the coat had a pleasing hand. Water drops were applied to the surface of the coat and did not cause water spotting, but rather beaded on the surface, indicating good water resistance. The results of the examples illustrate that the dry cleaing process of this invention restores softness and water resistance to dry cleaned leathers.

What is claimed is:

1. In the process of dry cleaning leather, the improvement which comprises having present in the dry cleaning solvent an epoxy-containing silicone compound of the formula:

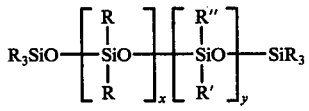

wherein R is an alkyl radical containing from 1 to 4 carbon atoms, R″ is an alkyl radical containing from 1 to 40 carbon atoms, R′ is an organic radical containing a vicinal epoxy group, $x$ has a value of from 10 to 1,000 and $y$ has a value of from 1 to 100.

2. The process as claimed in claim 1, wherein R and R″ are methyl, R′ has the formula:

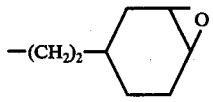

$x$ has an average value from 150 to 550 and $y$ has an average value of from 4 to 15.

3. The process as claimed in claim 1, wherein the amount of the epoxy-containing silicone present in the cleaning solvent is from 0.5 weight percent to 10 weight percent of the leather being cleaned.

4. The process as claimed in claim 1, wherein the amount of the epoxy-containing silicone present in the cleaning solvent is from 0.5 weight percent to 5 weight percent of the leather being cleaned.

* * * * *